US009197335B2

(12) United States Patent
Smereka et al.

(10) Patent No.: US 9,197,335 B2
(45) Date of Patent: Nov. 24, 2015

(54) SYSTEM AND METHOD FOR AUTOMATICALLY INSERTING ADVERTISING AND OTHER CONTENT INTO PLAYBACK OF A BROADCAST SIGNAL

(71) Applicant: Myine Electronics, Inc., Ferndale, MI (US)

(72) Inventors: Scott W. Smereka, Warren, MI (US); Donald J. Ebben, Novi, MI (US); Jacob R. Sigal, Ferndale, MI (US)

(73) Assignee: MYINE ELECTRONICS, INC., Ferndale, MI (US)

( * ) Notice: Subject to any disclaimer, the term of this patent is extended or adjusted under 35 U.S.C. 154(b) by 296 days.

(21) Appl. No.: 13/750,571

(22) Filed: Jan. 25, 2013

(65) Prior Publication Data

US 2013/0203339 A1 Aug. 8, 2013

Related U.S. Application Data

(60) Provisional application No. 61/736,675, filed on Dec. 13, 2012, provisional application No. 61/591,698, filed on Jan. 27, 2012.

(51) Int. Cl.
*H04H 40/00* (2009.01)
*H04H 20/10* (2008.01)

(52) U.S. Cl.
CPC ..... *H04H 20/106* (2013.01)

(58) Field of Classification Search
None
See application file for complete search history.

(56) References Cited

U.S. PATENT DOCUMENTS

| | | | | |
|---|---|---|---|---|
| 8,249,497 | B2 | 8/2012 | Ingrassia et al. | |
| 2011/0177775 | A1* | 7/2011 | Gupta et al. | 455/3.06 |
| 2012/0035753 | A1* | 2/2012 | Ingrassia et al. | 700/94 |
| 2012/0077433 | A1* | 3/2012 | Walker et al. | 455/41.1 |
| 2014/0080546 | A1* | 3/2014 | Gorilovsky | 455/566 |

* cited by examiner

*Primary Examiner* — Edward Urban
*Assistant Examiner* — Mohammed Rachedine
(74) *Attorney, Agent, or Firm* — Harness, Dickey & Pierce, P.L.C.

(57) ABSTRACT

A system is disclosed for inserting selected content into a signal being broadcast by a broadcast station, and being received by a vehicle radio system. A vehicle radio system may be incorporated which has a processing system. A personal electronic device (PED) able to be carried by a user is also used. The PED may supply selected content to the processing system. The processing system may detect a first signal in the received broadcast signal that indicates a commercial break period of predetermined duration is to begin, and a second signal in the received broadcast signal that indicates that the commercial break period is to end. The processing system may obtain the selected content from the PED and insert the obtained, selected content into the broadcast signal for seamless playback through the vehicle radio system during the commercial break period.

20 Claims, 4 Drawing Sheets

SYSTEM AND METHOD FOR AUTOMATICALLY INSERTING ADVERTISING AND OTHER CONTENT INTO PLAYBACK OF A BROADCAST SIGNAL

CROSS-REFERENCE TO RELATED APPLICATIONS

This application claims the benefit of U.S. Provisional Application No. 61/736,675, filed Dec. 13, 2012 and U.S. Provisional Application No. 61/591,698, filed Jan. 27, 2012. The entire disclosures of each of the above applications are incorporated herein by reference.

FIELD

The present disclosure relates to systems and methods for playing back broadcast signal content from a broadcast source over a vehicle radio, and more particularly to a system and method which is able to automatically insert predetermined content into the playback of a broadcast signal on a vehicle radio at predetermined, detected times during receipt of the broadcast signal, as well as to provide various data associated with the vehicle, its location and/or its components to cloud-based third parties. The third parties may then supply additional information or additional content back to the broadcast source or back to the vehicle radio. The additional content may also be inserted into playback of the broadcast or otherwise used by the broadcast source as needed.

BACKGROUND

The statements in this section merely provide background information related to the present disclosure and may not constitute prior art.

Advertisers are continually looking at ways to better and more effectively market their goods and services to consumers. When providing advertising content to a consumer, which is delivered over an AM/FM or digital broadcast, an advertising entity does not have a wide degree of latitude in selecting or tailoring advertising ("AD") content to the consumers. The broadcast facility merely inserts whichever AD content spots have been "queued up" whenever commercial breaks are to be provided in the broadcast signal. Put differently, there isn't the opportunity of the advertiser to tailor its AD content to specific individuals. The queued up AD content spots are simply broadcast, during those commercial break periods in the broadcast, and whichever individuals happen to be listening to the broadcast signal at that particular moment will receive AD content during the broadcast. Thus, for example, 25 year old females listening to a broadcast station broadcasting "easy listening" music will receive the same AD content as a 45 year old male who is listening to the same broadcast. However, there presently is no way for the delivery of AD content to be tailored to so that different AD content can be provided to the 25 year old female and the 45 year old male, during those commercial break times in a broadcast signal, so that the AD content is highly tailored to the differing interests of such individuals.

Another limitation is the inability of a broadcast source to obtain real time "back end data" concerning the user's listening habits, the user's vehicle and/or the location of the user's vehicle. By "back end data" it is meant data or information such as, without limitation, the vehicle make/model, diagnostics information concerning the vehicle generated by the vehicle's on-board computer, microphone audio input by the user into the vehicle's audio system, real time location information from the vehicle's navigation system, radio button selections made by the user, etc. These are only intended to show a few examples of the wide range of information and data that may be made available to a remote source as "back end data", and those skilled in the art will appreciate that virtually any information or data that may originate from the vehicle could potentially be included as back end data. As another example, detection of deployment of the vehicle's airbag could be included as back end data transmitted via a cellular connection to a cloud-based monitoring facility. Presently this valuable data is not typically used by the broadcast source or other third parties, nor is it used to help select additional content that may be supplied to the vehicle's radio system while the vehicle is in use by the user.

SUMMARY

In one aspect the present disclosure relates to a system for inserting selected content into a broadcast signal being broadcast by a broadcast station, and being received by a radio system of a vehicle. The system may comprise a vehicle radio system having a processing system and a personal electronic device. The personal electronic device may be adapted to be carried by a user. The personal electronic device may further be configured to supply selected content to the processing system. The processing system may further be configured to detect a first signal in the broadcast signal being received that indicates a commercial break period of predetermined duration is to begin, and a second signal in the broadcast signal being received that indicates that a commercial break period of predetermined duration is to end. The processing system may further be configured to obtain the selected content from the personal electronic device and to insert the obtained, selected content into the broadcast signal for seamless playback through the vehicle radio system during the commercial break period.

In another aspect the present disclosure relates to a system for inserting selected content into a broadcast signal being broadcast by a broadcast station, and being received by a radio system of a vehicle. The system may comprise a vehicle radio system having a processing system and a personal electronic device. The personal electronic device may be adapted to be carried by a user. The personal electronic device may further being configured to supply selected content to the processing system. The processing system may be configured to detect a first signal in the broadcast signal being received that indicates a commercial break period of predetermined duration is beginning, and a second signal in the broadcast signal being received that indicates that a commercial break period of predetermined duration has ended. The processing system may further be configured to obtain the selected content from the personal electronic device and to insert the obtained, selected content into the broadcast signal for seamless playback through the vehicle radio system when the commercial break period is detected as beginning, and to return to the playing the broadcast signal when the commercial break period is detected as having ended. The processing system may further provide data concerning at least one of the vehicle or a component of the vehicle to the personal electronic device.

In another aspect the present disclosure relates to a system for managing and monitoring listening habits of a user of a vehicle. The system may comprise a personal electronic device adapted to be carried by a user when travelling in a vehicle, and a vehicle radio system configured to receive a broadcast from a broadcast station. The vehicle radio system may further be configured to detect when a commercial break period in the broadcast is beginning and ending, and to insert selected content into the broadcast to be played back over the vehicle radio system during the commercial break period. The personal electronic device may further be configured to wirelessly report information to a remote facility that tracks listening activities of the user.

In still another aspect the present disclosure relates to a method for inserting selected information content into a broadcast being wirelessly received by a vehicle radio system. The method may comprise using a vehicle radio system to wirelessly receive a broadcast and to detect a commercial break period in the broadcast. The vehicle radio system may be used to insert selected information into the broadcast during the commercial break period for playback over the vehicle radio system. The vehicle radio system may also be used to detect when the commercial break period has ended and to return to playing back the broadcast over the vehicle radio system. The vehicle radio system may also be used to provide data concerning at least one of the vehicle or an operation of a component of the vehicle to the personal electronic device.

BRIEF DESCRIPTION OF THE DRAWINGS

The drawings described herein are for illustration purposes only and are not intended to limit the scope of the present disclosure in any way.

DETAILED DESCRIPTION

Figure 1:
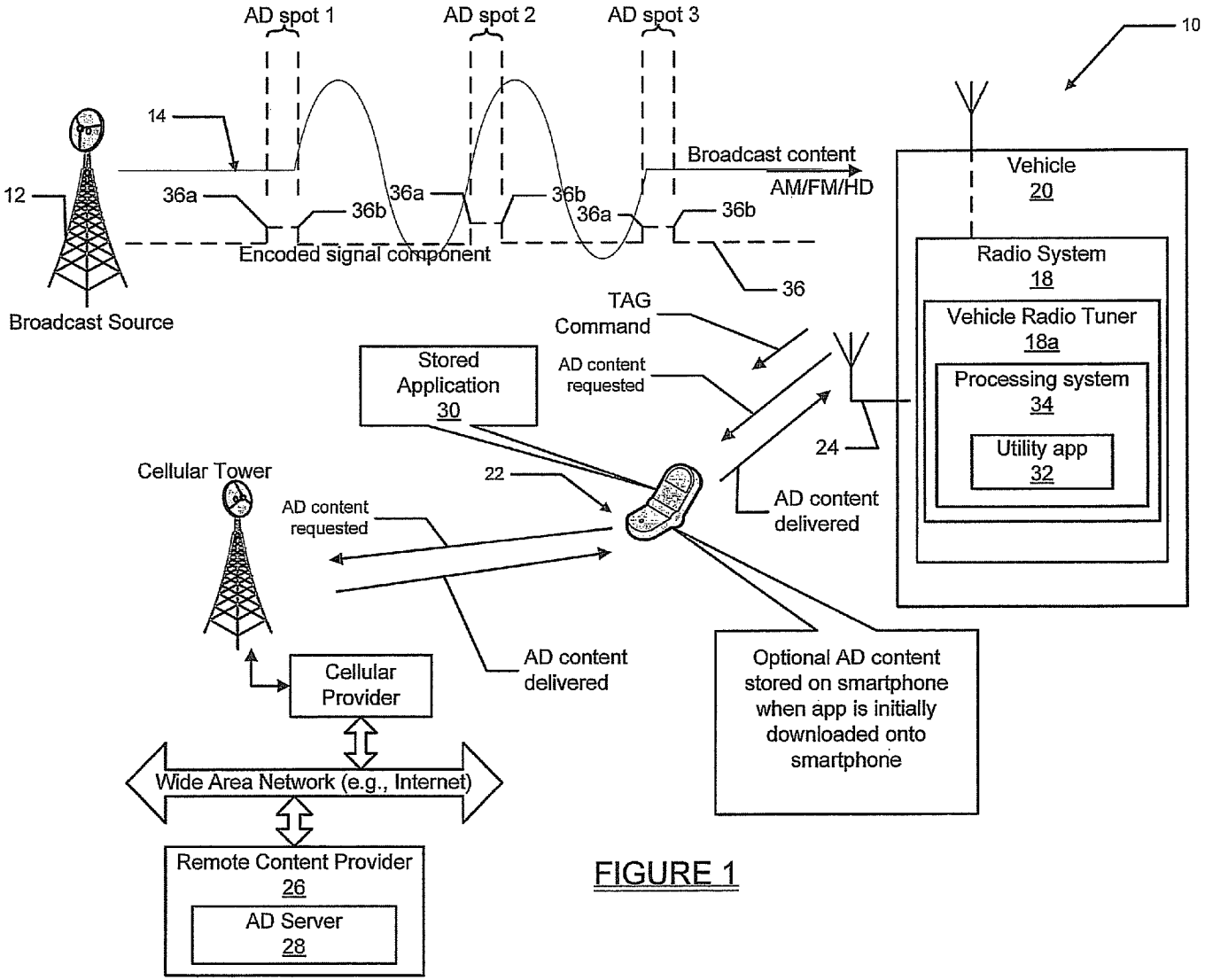
FIG. 1 is a high level block diagram illustration of a system in accordance with one embodiment of the present disclosure in which predetermined AD content is able to be seamlessly "inserted" into a broadcast signal being received at a vehicle radio of a vehicle, using the vehicle operator's cell phone to provide the predetermined AD content.

The following description is merely exemplary in nature and is not intended to limit the present disclosure, application, or uses. It should be understood that throughout the drawings, corresponding reference numerals indicate like or corresponding parts and features.

Referring to FIG. 1, there is shown a system 10 in accordance with one embodiment of the present disclosure for switching between playback of predetermined AD content and a broadcast signal being received. The system 10 may involve the use of a broadcast source 12 which transmits a broadcast signal 14 (AM/FM or HD radio). Simply for the purpose of explanation, it will be assumed that the broadcast signal 14 is an FM signal. The broadcast signal 14 is received by an antenna 16 associated with a vehicle radio tuner 18*a* of a radio system 18 within a vehicle 20 which an individual may be operating. The individual has a cellular phone 22, which in this example is a "smartphone" having its own processing, memory and wireless communications capabilities, as well known in the art.

The smartphone 22 is in contact with the vehicle radio tuner 18*a* through a wireless communications link with a second antenna 24, which may be designed to receive low power signals such as those used in accordance with the BLUETOOTH® wireless communications protocol. The smartphone 22 is also in wireless contact with a remote AD content provider 26 operating an AD server 28. The smartphone 22 may also include an application 30 stored in a memory thereof that the user has downloaded from a source of applications (not shown). The application 30 may relate to a particular broadcast source (i.e., radio station) that the user likes to listen to. Thus, the application 30 may be for a specific broadcast source, just for example a broadcast source having call letters WZZZ associated with FM frequency 105.1 MHZ in the metro Detroit, Mich. area. The application 30 may also operate to control the smartphone 22 to contact the remote AD content provider 26 and obtain specific AD content that has been created for specific types/classes of listeners of the broadcast source 12. In this regard, the initial downloading of the application may also involve having the user answer specific questions about the user's age, gender, profession/occupation, and other interests, which criteria may be used by the remote content provider 26 in more finely tailoring the supply of AD content to the user from the AD server 28. Optionally, a quantity of AD content may be provided when the application 30 is first downloaded onto the user's smartphone 22 so that the smartphone does not need to make a wireless connection with the remote content provider 26.

The vehicle radio tuner 18*a* may also have stored thereon a utility application 32 (i.e., software program) that is stored in a suitable memory (e.g., RAM) of a processing system 34 of the tuner. Alternatively, it will be appreciated that the processing system 34 and the utility application 32 could be part of a completely independent electronic subsystem which is independent of the vehicle's radio system 18, and which is interfaced to the vehicle's 20 electronics as needed to interact with the radio system 20 (e.g., through an auxiliary "IN" port). The utility application 32 may be started when the radio system 18 is turned on or when the vehicle 20 is started.

The utility application 32 may use the low power, wireless BLUETOOTH.®. communications link between it and the smartphone 22 to inform the smartphone when the user has selected a radio station that corresponds to the stored application 30. In this example, the selected radio station would be WZZZ and the stored application corresponds to the WZZZ radio station. This causes the processing system 34 to begin monitoring the broadcast signal 14, and more specifically an encoded signal component 36 that is mixed in to the broadcast signal. In one example the encoded signal component may be an encoded harmonic signal component, provided that the broadcast signal 14 is an AM or FM analog broadcast. Otherwise, the encoded signal component 36 could simply be low magnitude digital pulses in an HD broadcast (i.e., not audibly perceptible to the user but still detectable with suitable electronic D/A detector circuitry). Still further, the encoded composite signal could be present in a sub-band within the HD1, HD2 or FM RDS stream (i.e., not in the same audio stream that the audio broadcast is played through). Simply for the purpose of providing one example implementation, the broadcast signal 14 will be assumed to be an FM signal, with the encoded signal component 36 being a "harmonic signal component."

The processing system 34 uses the utility application 32 to detect specific "markers" that are modulated in the harmonic signal component 36 of the broadcast signal 14 along with the primary audio signal content. In this regard it will be appreciated that the harmonic signal component 36 is transmitted concurrently with, and forms a portion of, the broadcast signal 14, but will be inaudible when the broadcast signal 14 is played back by the vehicle's radio system 18. The harmonic signal component 36 may be detected and monitored by the processing system 34 of the radio tuner 18*a* using band pass techniques or signal level detection techniques, or any other suitable means of detection. It is important to emphasize, however, that the harmonic signal component 36 does not degrade or otherwise audibly influence the playback of the audio content that is provided via the broadcast signal 14. In other words, the presence of the harmonic signal component 36 will not be apparent to the user who is listening to the playback of the broadcast signal 14 via the radio system 20.

With further reference to FIG. 1, merely for simplicity, the harmonic signal component 36 is illustrated as a digital waveform having a plurality of pulses that appear during times where an "AD spot" is present. A leading edge 36*a* of each pulse of the harmonic signal component 36 defines a "Start Marker" and the trailing edge 36*b* of each pulse defines an "End Marker". A duration between the Start Marker 36*a* and the Stop Marker 36*b* defines a time space that is concurrent with an "AD spot", or in other words a time slot corresponding to a commercial break where the broadcast source 12 would normally insert AD content into the broadcast signal 14. The Start Marker 36*a* is used by the utility application 32 and the processing system 34 to detect, in real time, that specific point in the broadcast signal 14 where the broadcast source 12 is starting a commercial break period and inserting AD content into its broadcast signal 14. Likewise, the Stop marker 36*b* defines that specific point in time in the broadcast signal 14 where the broadcast source 12 ends the commercial break (i.e., the AD spot) and begins retransmitting its primary content (e.g., music, talk radio, etc.).

It will also be appreciated that if an HD digital signal is being broadcast by the broadcast source 12, a "TAG" command could be selected from a suitable TAG command button on the vehicle radio, or possibly from the user's smartphone 22, to indicate that the specific content being received (e.g., song) is to purchased or otherwise identified for some other additional use at a later date/time. Another significant feature of the system 10 is the ability to track the location of the user's smartphone 22, and thus the real time location of the vehicle 20, using conventional location determining techniques. Such conventional techniques may involve triangulation with signal strength information provided from multiple cellular towers that are in range of the smartphone 22 and/or signals from satellites of the Global Positioning Satellite (GPS) system. Based on the determined real time location of the vehicle 20, the remote content provider 26 can even further tailor AD content provided from the AD server 28 so that specific restaurants, businesses or entertainment venues that are within a predetermined range (e.g., 5 miles) of the user's present location are provided during the AD spots.

Figure 2:
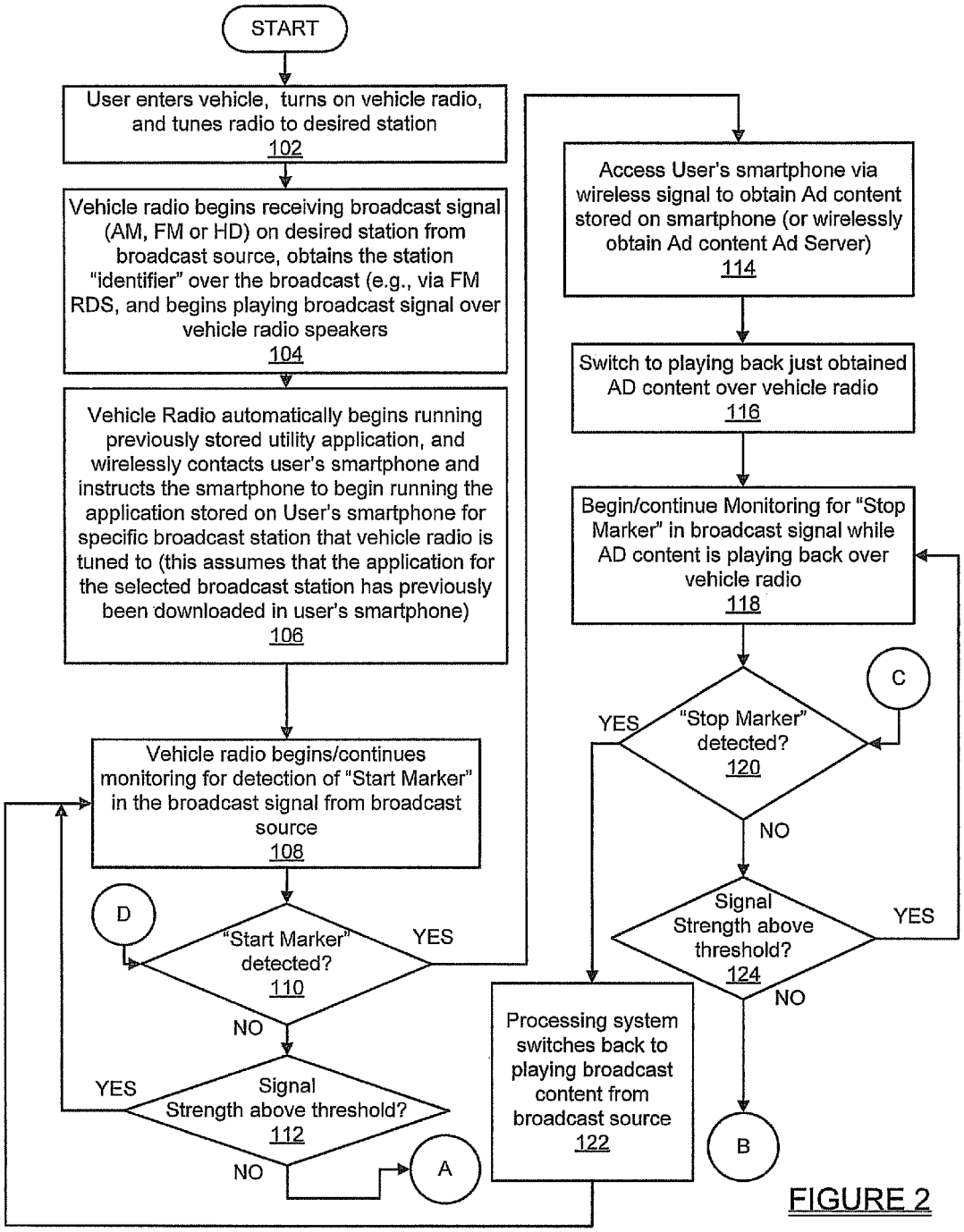
FIGS. 2 and 3 represent a high level flowchart of operations that may be performed by the system of FIG. 1 in inserting AD content into a broadcast signal being received and played back on a vehicle radio.

Referring now to FIG. 2, a flowchart 100 is shown describing in greater detail the operations summarized above which are being performed by the system 10. At operation 102 the user enters her/his vehicle, turns on the radio system and tunes to a desired station. For this example it will be assumed that the desired station is the WZZZ FM radio station mentioned above. At operation 104 the vehicle radio begins receiving the broadcast signal content from the WZZZ broadcast station 12, then obtains the RDS information for the selected station, and then begins playing the received content over the radio system's 18 speakers. If an HD signal is being received, the station identifying information can be presented through the HD radio feed. Again, it will be assumed for this example that an FM signal is being received. The station identifying information may include the call sign for the received station, and possibly additional information like location for a station or possibly some other unique identifying information.

At operation 106 the vehicle radio system 18 automatically begins running the previously stored utility application 32 and wirelessly contacts the user's smartphone 22 via the BLUETOOTH® communications link. The utility application 32 may automatically instruct the smartphone 22 to begin running the application 30 stored on the smartphone for the specific broadcast station that the vehicle radio system 18 is tuned to. Alternatively, the user may be required to manually start the application 30 stored on the smartphone 22. In this example the application 30 will be for the WZZZ radio station and it will be assumed that the smartphone 22 and the application 30 possess the functionality required to be started automatically by a suitable wireless signal received from the radio system 18.

At operation 108 the processing system 34 and the utility application 32 begin monitoring for the detection of a "Start Marker" in the FM broadcast signal 14 being broadcast from the broadcast source 12. At operation 110 a check is made if the "Start Marker" 36*a* has been detected. If not, then a check is made if the signal strength of the received broadcast signal 14 is above a predetermined minimum threshold, as indicated at operation 112. If it is, then operation 108 is repeated. If the check at operation 110 indicates that the "Start Marker" 36*a* has been detected, then at operation 114 the utility application 32 accesses the user's smartphone 22 via the BLUETOOTH wireless communications link with the smartphone to obtain AD content stored on the smartphone. This involves the smartphone 22 contacting the remote content provider 26 to obtain the specific AD content from the AD server 28. Optionally the AD content could be stored in the smartphone's 22 memory and provided therefrom to the processing system 34. At operation 116 the processing system 34 controls the switching of the radio system 18 so that the AD content just obtained from the smartphone 22 may be played back over the vehicle's radio system 20, as indicated at operation 116.

Figure 3:
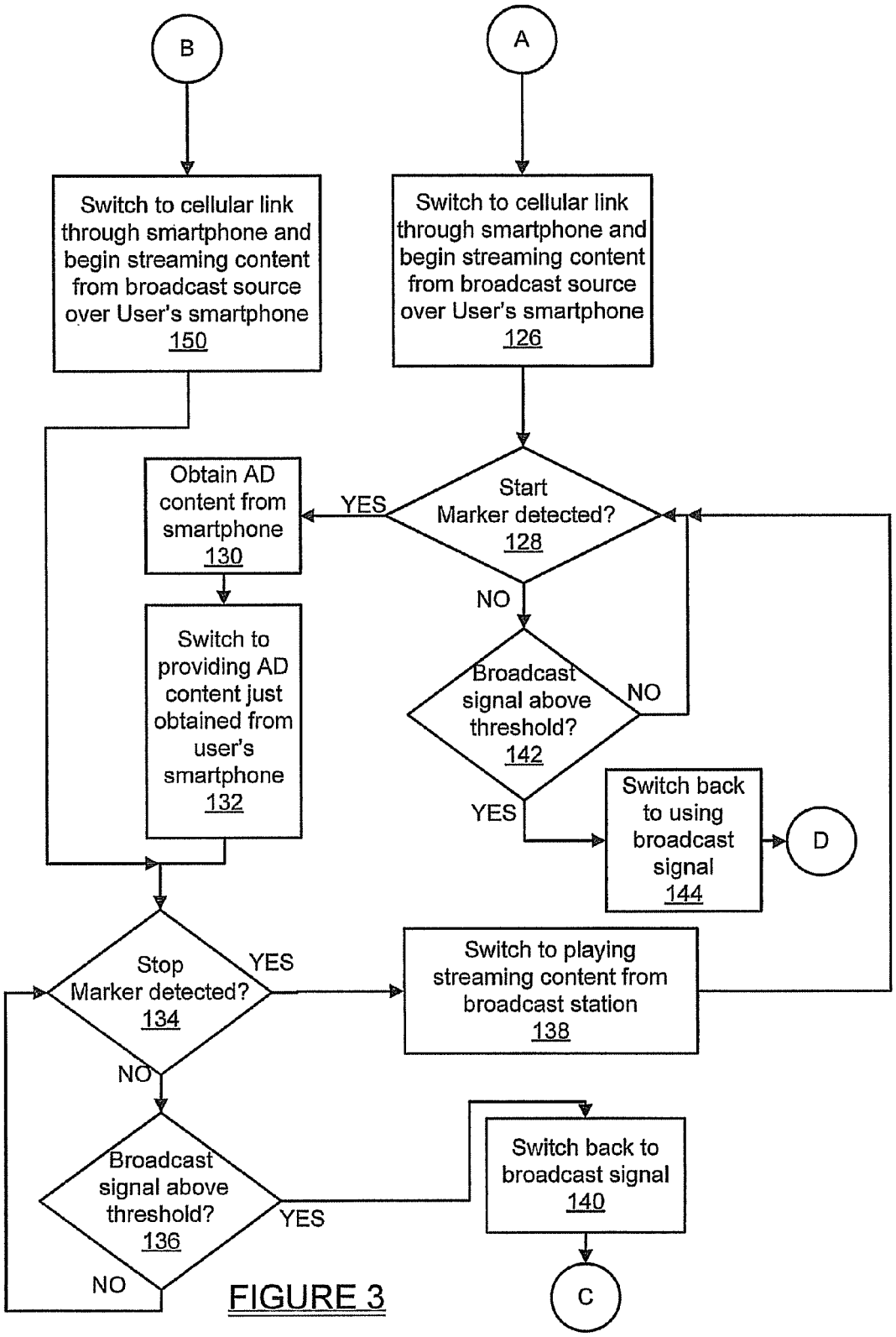

At this point, the processing system 34 will begin (or continue) monitoring for a "Stop Marker" 36*b* in the broadcast signal 14, as indicated at operation 118. This involves making a check for the "Stop Marker" 36*b*, as indicated at operation 120. If a "Stop Marker" is detected at operation 120, then the processing system 34 switches back to playing broadcast content from the broadcast source 12 (i.e., content delivered via broadcast signal 14), as indicated at operation 122. Alternatively, a "Stop Marker" or "end-of-file" indication may also be received from the smartphone 22 that tells the processing system 34 and the utility application 32 that the AD content being supplied by it has concluded. Both types of signal detection are contemplated as being handled at operation 120. Operation 108 is then repeated to start checking again for the next "Start Marker" 36*a*. If the check at operation 120 does not detect a "Stop Marker" 36*b*, then a check is made if the signal strength of the broadcast signal 14 is above the predetermined threshold, as indicated at operation 124. If this check produces a "YES" answer, then operation 118 is repeated. If it produces a "NO" answer, then operation 150 in FIG. 3 is performed. Similarly, if the signal strength check at operation 112 produces a "NO" answer, then operation 126 in FIG. 3 is performed.

Referring to FIG. 3, and as noted above, if either of the checks at operations 112 or 124 indicate that the signal strength has dropped below the predetermined threshold, then the processing system 34 knows to begin providing the broadcast content from a streaming signal source (not shown in FIG. 1). This assumes that the broadcast station WZZZ in this example also streams its broadcast over a wide area network, for example the Internet. At operation 126 then, the processing system 34 begins also receiving the streaming broadcast and then begins checking for a "Start Marker" in the streamed signal. In this example the streamed digital signal will also have some form of signal component by which a "Start Marker" may be included in the digital signal without otherwise affecting the quality of the played back signal content. At operation 128 a check is made if the "Start Marker" in the streamed signal is present, and if it has been detected, then the AD content is obtained from the user's smartphone for playback at operation 130. At operation 132 the processing system 34 switches to providing the AD content just obtained from the user's smartphone 22. At operation 134 the processing system 34 then starts checking for the presence of a "Stop Marker" in the streaming digital signal being received. If the check at operation 134 detects that a "Stop Marker" has been received, the processing system 34 will then switch back to playing the streaming digital content from the broadcast station, as indicated at operation 138. Again, the "Stop Marker" may have been received directly from the smartphone 22 or an end-of-file indication supplied by the Smartphone to indicate that the AD content has finished. Operation 128 will then be repeated. If the check at operation 134 indicates the "Stop Marker" has not been detected, then a check is made at operation 136 to see if the signal strength of broadcast signal 14 is back above the predetermined minimum threshold. If it is, then at operation 140 the processing system switches back to using the broadcast signal 14, and then jumps back to operation 120 in FIG. 2.

If the "Start Marker" was not detected at operation 128 in FIG. 3, then a check is made if the signal strength of the broadcast signal is above the minimum predetermined threshold, as indicated at operation 142. If it is, then the processing system 34 switches back to using the broadcast signal 14, and then operation 110 in FIG. 2 is repeated.

From the foregoing it will be appreciated that the present system 10 and method is able to receive a broadcast signal and to automatically switch back and forth between playing the content provided via the broadcast signal and playing highly tailored AD content from an independent source of AD content. Importantly, the AD content obtained from the independent source of AD content is only played during those times of the broadcast signal where commercial breaks would ordinarily be occurring. The system 10 and method further automatically and seamlessly detects when the commercial break periods are beginning and when they end, so that the user is able to receive the programming content (e.g., music, talk radio, etc.) from the broadcast source without interruption. The system and method further is able to provide highly tailored AD content based on the real time location of the user, when this feature is implemented in the system 10. Still further, the system and method is able to automatically and seamlessly switch between the broadcast signal and a streaming digital signal, in the event the signal strength of the broadcast signal form the broadcast source becomes too weak to receive. The highly tailored AD content is tailored for each specific user, and enables advertisers to even more effectively promote their products and services to specific listeners.

Figure 4:
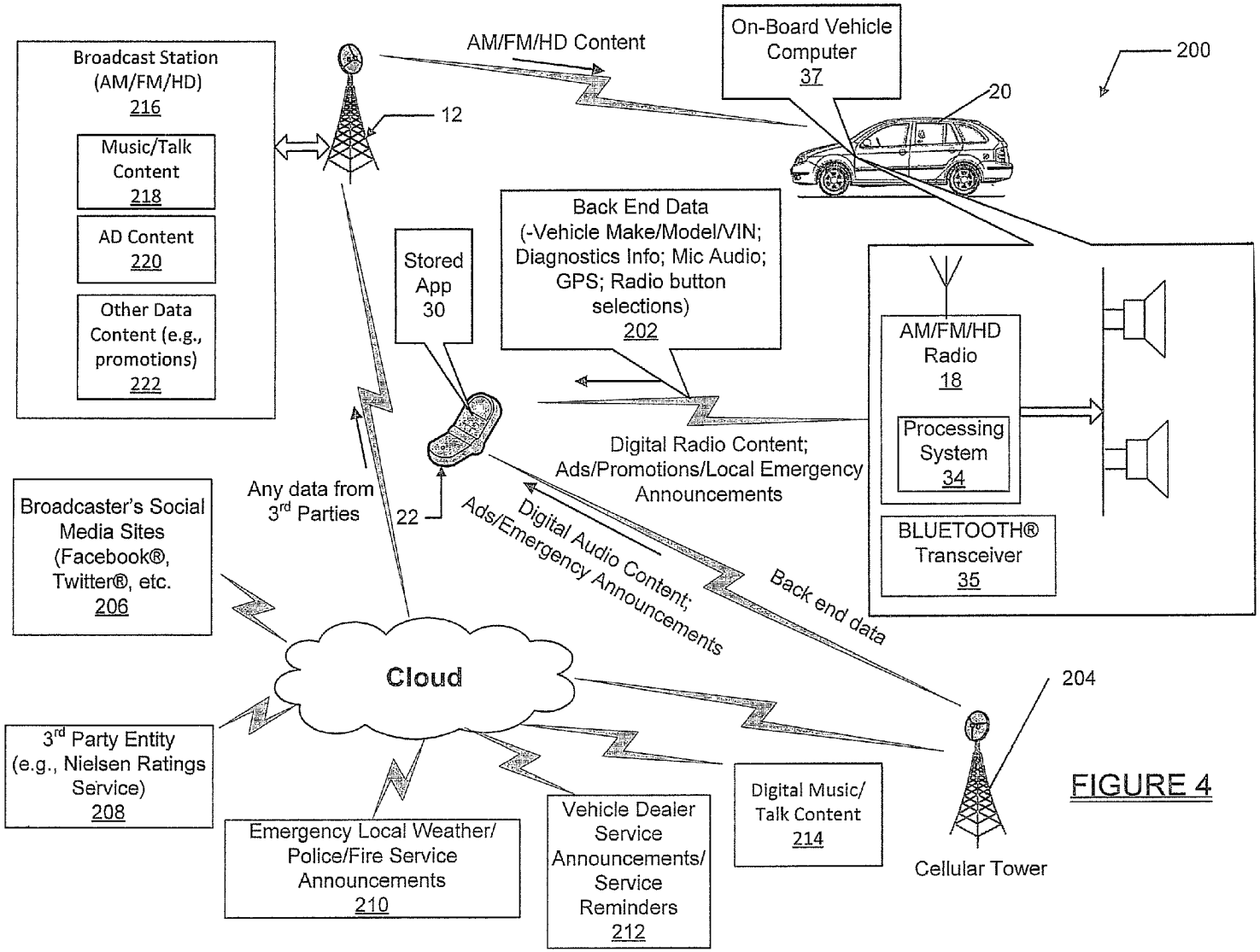
FIG. 4 is a high level block diagram of another embodiment of the present disclosure in which back end data is collected and distributed to one or more cloud-based third parties, and then information concerning the user, the user's vehicle or the vehicle's real time location may be used to generate additional content that may be supplied back to the broadcast source, or alternatively supplied directly to the vehicle's radio system.

Referring now to FIG. 4, a system 200 and methodology in accordance with another embodiment of the present disclosure is illustrated. The system 200 is somewhat similar to system 10 described in connection with FIG. 1, but goes much further with exploiting the collection, analysis and use of "back end data" 202 generated from the vehicle 20. The vehicle 20 includes the radio system 18 and the processing system 34, and in this embodiment may also include a BLUETOOTH® wireless protocol transceiver 35 (or any wireless, short range protocol transceiver) for making a wireless, short range connection with the user's cell phone 22. The vehicle 20 may also include an on-board vehicle computer 37 which communicates with the vehicle's various on-board electronics monitoring and management subsystems. The on-board vehicle computer 37 may be in communication with the radio system 18. The cell phone 22 makes use of the stored application 30 as described in FIG. 1.

With further reference to FIG. 4, the system 200 makes extensive use of the back end data 202, which may include a wide range of diverse information such as, without limitation, the vehicle make and model, the vehicle VIN, real time vehicle diagnostics information collected by the on-board vehicle computer 37, microphone audio input to the radio system 18, real time navigation information concerning the vehicle's 20 location, radio button selections made by the user, etc. Additional information such as real time vehicle odometer mileage and other information pertinent to the operation of the vehicle may also be part of the back end data 202. Those skilled in the art will appreciate that the foregoing examples of the back end data 202 are not intended to be exhaustive, but merely illustrative of the wide ranging and diverse nature of the information that may form the back end data 202.

The back end data 202 may be forwarded via the wireless link to the user's smartphone 22, and then relayed to a nearby cellular tower 204. The cellular tower 204 may package the information in packet form and relay the packetized information via a wide area network (e.g., the Internet) to one or more cloud based entities. Various examples of cloud based entities have been shown in FIG. 4 as being one or more of the broadcaster's social media sites 206 (e.g., Facebook®, Twitter®, LinkedIn®, etc.); a third party ratings agency 208 (e.g., Nielsen Ratings Service); an emergency local weather/police/fire service announcement system 210; a vehicle dealer service announcements/reminders system 212; and a digital music/talk content source 214. These above-listed cloud-based entities are only intended to illustrate a small number of the different types of entities that may use the back end data 202 for various purposes. Those skilled in the art will appreciate that other types of entities could just as easily be integrated into the system 200.

Certain ones of the remote entities 206-214 may supply information generated in response to analysis of the back end data 202 back to the broadcast tower 12. This information may then be used by the broadcast station 216 to analyze programming and/or to help control or select the type of content to be inserted into the signal being broadcast from the tower 12. Alternatively, the information obtained from the cloud-based device or devices may be received at the broadcast station 216 as packetized information via a wide area connection (e.g., Internet connection) available to the broadcast station 216. The broadcast station 216 in this embodiment may provide music/talk content 218, AD content 220 that is selectively inserted in its broadcasted signal, as well as other data content (e.g., promotions, etc.) that can also be selectively inserted in the broadcasted signal. As such, rather than selectively inserting AD content into the signal broadcast from the tower 12, promotion content could be inserted. For example, such promotion content or other types of data content 222 could also be inserted into the signal being broadcast.

It will be appreciated then that the ability to supply a wide variety of real time back end data back 202 to various cloud-based entities is expected to be highly helpful and valuable to the broadcast station 216. For example, ratings information supplied back to the broadcast station 216 from a cloud-based ratings agency that is receiving at least a portion of the back end data 202 can be used to help the broadcast station 216 tailor the music/talk content and/or the AD content or promotion content accordingly. The real time back end data 202 can also be valuable to the broadcast station 216 in updating its social media sites quickly. The ability to supply local weather, police, fire or other emergency information back to the user's smartphone 22, essentially in real time, is highly valuable in keeping the user abreast of important local emergency developments that the user would want to be made aware of. For example, a weather emergency announcement could be sent back to the user's smartphone 22 and may interrupt music or talk content being streamed to the smartphone 22 and being played over the radio system 18. Likewise, emergency traffic information or other public safety announcements could be immediately uploaded to the user's smartphone 22 by using the real time location of the vehicle, as supplied by the vehicle's navigation system or the user's smartphone 22.

The ability to send vehicle information as part of the back end data 202 enables a wide range of important vehicle information (e.g., odometer, failure codes recorded by the vehicle's on-board computer 37, etc.) to be supplied to various interested parties. For example, mileage information could potentially be supplied to a vehicle dealer where the user had purchased the vehicle. Receipt of this mileage data could enable the dealer to send a text message to the smartphone 22 to remind the user of the need for an oil change once the vehicle mileage reaches a predetermined value. Potentially, even vehicle failure codes received by the on-board computer 37 could be included in the back end data (e.g., oxygen sensor failure) that is sent to one or more cloud-based entities. These failure codes could be transmitted to a cloud-based service center that the vehicle dealer operates. Receipt of specific types of failure/error codes could be used by the vehicle dealer to determine whether it is necessary to send a text message to the vehicle owner alerting him/her that a malfunction with a component of the vehicle has been determined, and that the user should consider bringing the vehicle in for service at the earliest possible time. Another example would be including a vehicle system voltage in the back end data. A low vehicle system voltage could indicate that a battery of the vehicle is close to failing. The vehicle dealer could notify the user via a text message sent to the user's smartphone 22 that a battery failure may be imminent, and that the vehicle should be brought in for a service check. These are but a few examples of highly valuable information that could be included as back end data 202.

From the foregoing it will be appreciated that the various embodiments of the present disclosure enable advertisements, promotional announcements, real time emergency weather/police/fire and other information to be selectively inserted into content being broadcast by a broadcast station. Valuable back end data is also collected and transmitted from the user's smartphone 22 to various cloud-based entities, and then made available either to the broadcast station or to other entities. A wide range of uses can be made of the back end data that enhance the experience of the user while travelling in a motor vehicle.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A system for inserting selected content into a broadcast signal being broadcast by a broadcast station, and being received by a radio system of a vehicle, the system comprising:

a vehicle radio system having a processing system running an application thereon;

a personal electronic device adapted to be carried by a user, the personal electronic device further being configured to supply selected content to the processing system;

the processing system further configured to use the application running thereon to detect a first signal in the broadcast signal being received that indicates a commercial break period of predetermined duration is to begin, and a second signal in the broadcast signal being received that indicates that a commercial break period of predetermined duration is to end; and the processing system further configured to obtain the selected content from the personal electronic device and to insert the obtained, selected content into the broadcast signal for seamless playback through the vehicle radio system during the commercial break period.

2. The system of claim 1, wherein the personal electronic device is configured to contact a remote content center to obtain the selected content and to supply the selected content to processing system.

3. The system of claim 2, wherein the personal electronic device is configured to contact a remote content center to obtain at least one of:

advertising content;

an emergency announcement;

a weather announcement;

a traffic announcement;

digital music content; and digital talk content.

4. The system of claim 1, wherein the personal electronic device is configured to store the selected content thereon.

5. The system of claim 1, wherein the personal electronic device comprises a smartphone.

6. The system of claim 1, further comprising:

a first short range, wireless transceiver operably associated with the radio system of the vehicle;

a second short range, wireless transceiver operably associated with the radio system of the vehicle; and wherein the first and second short range, wireless transceivers are configured to automatically establish a wireless link when the personal electronic device is brought into proximity to the radio system of the vehicle.

7. The system of claim 6, wherein the first and second short range, wireless transceivers are configured to transfer information concerning the vehicle to the electronic personal device.

8. The system of claim 6, the system further comprising a real time locating system for providing information on a real time location of the personal electronic device.

9. A system for inserting selected content into a broadcast signal being broadcast by a broadcast station, and being received by a radio system of a vehicle, the system comprising:

a vehicle radio system having a processing system with an application running thereon;

a personal electronic device adapted to be carried by a user, the personal electronic device further being configured to supply selected content to the processing system;

the processing system further configured to use the application to inform the personal electronic device of information pertaining to the broadcast signal being received, and to detect a first signal in the broadcast signal being received that indicates a commercial break period of predetermined duration is beginning, and a second signal in the broadcast signal being received that indicates that a commercial break period of predetermined duration has ended;

the processing system further configured to:

obtain the selected content from the personal electronic device and to insert the obtained, selected content into the broadcast signal for seamless playback through the vehicle radio system when the commercial break period is detected as beginning, and to return to the playing the broadcast signal when the commercial break period is detected as having ended; and provide data concerning at least one of the vehicle or a component of the vehicle to the personal electronic device.

10. The system of claim 9, wherein the data involves at least one of:

a vehicle make;

a vehicle model name;

a vehicle identification number (VIN);

diagnostic information from an onboard system of the vehicle;

real time location of the vehicle; and selection of one or more controls of the radio system of the vehicle.

11. The system of claim 9, wherein the personal electronic device is configured to contact a remote content center to obtain the selected content and to supply the selected content to processing system.

12. The system of claim 9, wherein the personal electronic device and the radio system each include a short range wireless transceiver for automatically establishing a wireless communications link between the personal electronic device and the radio system when the personal electronic device is brought into proximity with the radio system.

13. The system of claim 9, wherein the selected content comprises at least one of:

advertisements;

emergency announcements concerning at least of police or fire emergency situations;

weather alerts;

traffic information;

digital music content;

digital talk content.

14. A system for managing and monitoring listening habits of a user of a vehicle making use of a vehicle radio system, the system comprising:

a personal electronic device adapted to be carried by a user when travelling in a vehicle;

the vehicle radio system configured to receive the broadcast from a broadcast station, the vehicle radio system further being configured to:

use a processing system included in the vehicle radio system, and having an application running thereon, to detect a first signal component in the broadcast which indicates that a commercial break period in the broadcast is beginning, and a second signal component in the broadcast that indicates that the commercial break period is ending; and to insert selected content obtained from a source remote from the vehicle radio system, into the broadcast to be played back over the vehicle radio system during the commercial break period; and the personal electronic device further being configured to wirelessly report information to a remote facility that tracks listening activities of the user while using the vehicle radio system.

15. The system of claim 14, wherein the personal electronic device and the vehicle radio system each include a short range wireless transceiver for automatically establishing a wireless communications link between the personal electronic device and the vehicle radio system when the personal electronic device is brought into proximity with the vehicle radio system.

16. The system of claim 14, wherein the personal electronic device comprises a smartphone.

17. The system of claim 14, wherein the vehicle radio system is further configured to wirelessly report data to the personal electronic device, and wherein the data comprises at least one of:

a vehicle make;

a vehicle model name;

a vehicle identification number (VIN);

diagnostic information from an onboard system of the vehicle;

real time location of the vehicle; and selection of one or more controls of the radio system of the vehicle.

18. A method for inserting selected information content into a broadcast being wirelessly received by a vehicle radio system, the method comprising:

using a processing system having an application running thereon, which is operably associated with the vehicle radio system, to monitor the broadcast being wirelessly received, and to detect a first signal marking a start of a commercial break period in the broadcast;

using the vehicle radio system to insert selected information from a source remote from the vehicle radio system into the broadcast during the commercial break period for playback over the vehicle radio system;

using the processing system and the application running thereon, to detect a second signal which marks when the commercial break period has ended and to return to playing back the broadcast over the vehicle radio system; and using the radio system to wirelessly provide data concerning at least one of the vehicle or an operation of a component of the vehicle to the personal electronic device.

19. The method of claim 18, wherein providing data comprises providing at least one of:

a vehicle make;

a vehicle model name;

a vehicle identification number (VIN);

diagnostic information from an onboard system of the vehicle;

real time location of the vehicle; and selection of one or more controls of the radio system of the vehicle.

20. The method of claim 18, wherein using the vehicle radio system to insert selected data comprises using the vehicle radio system to insert at least one of:

advertisements;

emergency announcements concerning at least of police or fire emergency situations;

weather alerts;

traffic information;

digital music content;

digital talk content.

* * * * *